US006170459B1

(12) United States Patent
Ono et al.

(10) Patent No.: US 6,170,459 B1
(45) Date of Patent: Jan. 9, 2001

(54) FUEL INJECTION CONTROL ASSEMBLY FOR A CYLINDER-INJECTED ENGINE

(75) Inventors: Takahiko Ono; Hiromichi Hisato, both of Hyogo; Hirofumi Ohuchi, Tokyo, all of (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/576,906

(22) Filed: May 23, 2000

(30) Foreign Application Priority Data

Dec. 14, 1999 (JP) ..... 11-354683

(51) Int. Cl.[7] ..... F02B 5/00
(52) U.S. Cl. ..... 123/305; 123/478; 701/104
(58) Field of Search ..... 123/305, 478, 123/480; 701/104

(56) References Cited

U.S. PATENT DOCUMENTS 5,535,621 * 7/1996 Glidewell et al. ..... 123/478
5,832,901 * 11/1998 Yoshida et al. ..... 123/478
5,878,713 * 3/1999 Kadota ..... 123/305
5,881,694 * 3/1999 Nakada ..... 123/305
5,960,765 * 10/1999 Iida et al. ..... 123/305
5,960,768 * 10/1999 Monnier ..... 123/305
6,058,907 * 5/2000 Motose et al. ..... 123/305
6,067,957 * 7/1996 Motose et al. ..... 123/305
6,085,720 * 7/2000 Klare et al. ..... 123/305

FOREIGN PATENT DOCUMENTS 11-62676 3/1999 (JP) .
11-153054 6/1999 (JP) .

* cited by examiner

*Primary Examiner*—John Kwon
(74) *Attorney, Agent, or Firm*—Sughrue, Mion, Zinn, Macpeak & Seas, PLLC

(57) ABSTRACT

A fuel injection control assembly for a cylinder-injected engine includes a mean fuel pressure calculating element for calculating mean fuel pressure, a fuel pressure regulator for adjusting the fuel pressure, an injection pulse calculating element for calculating an injection pulse duration for an injector based on the mean fuel pressure, and a cycle modifying element for modifying the calculation cycle for the mean fuel pressure in response to the running speed of the engine or of a high-pressure pump, the cycle modifying element setting the calculation cycle to a length greater than or equal to a running cycle of the high-pressure pump to ensure that the number of times that fuel pressure is detected within each calculation cycle of the mean fuel pressure calculating element is greater than or equal to a predetermined number of times.

12 Claims, 15 Drawing Sheets

FUEL INJECTION CONTROL ASSEMBLY FOR A CYLINDER-INJECTED ENGINE

BACKGROUND OF THE INVENTION

1. Field of the Invention

The present invention relates to a fuel injection control assembly for a cylinder-injected engine for controlling fuel injection based on a mean fuel pressure acting on an injector, and in particular relates to a fuel injection control assembly for a cylinder-injected engine in which reliability is improved by calculating the mean fuel pressure to a high precision and ensuring that control and calculation track changes in the fuel pressure.

2. Description of the Related Art

Cylinder-injected engines in which an injector is disposed in a combustion chamber of an engine cylinder and fuel is injected directly into the combustion chamber are well known as referenced by Japanese Patent Laid-Open No. HEI 11-62676 and Japanese Patent Laid-Open No. HEI 11-153054, etc.

For example, the fuel injection control assembly for a cylinder-injected engine disclosed in Japanese Patent Laid-Open No. HEI 11-62676 includes a mean fuel pressure computing means for calculating the mean fuel pressure from weighted means of fuel pressure detected at times other than when the injector is injecting fuel, and correcting the length of an injection pulse which is output to the injector based on the mean fuel pressure.

The fuel injection control assembly for a cylinder-injected engine disclosed in Japanese Patent Laid-Open No. HEI 11-153054 detects fuel pressure at predetermined intervals (or in synchrony with a rotational angle of the engine) at times other than when the injector is injecting fuel.

FIG. 12 is a structural diagram schematically showing a generic fuel injection control assembly for a cylinder-injected engine.

In FIG. 12, injectors IF are disposed in each cylinder of an engine 1, the injectors IF injecting fuel directly into a combustion chamber in each cylinder.

Various sensors 2 for detecting running states and a fuel pressure sensor 12 are disposed in the engine 1. The various sensors 2 include a conventional airflow sensor, throttle sensor, crank angle sensor, etc.

Running information from the various sensors 2 and fuel pressure information PF from the fuel pressure sensor 12 are input into an electronic control unit (ECU) 20. The injectors 1F have electromagnetic solenoids activated by an injection pulse signal J from the ECU 20, the injectors 1F being opened by passing current through the solenoids.

Fuel supplied to the injectors 1F is drawn from a fuel tank 3 and adjusted to a target fuel pressure PFo in a high-pressure pipe 8. Thus, an amount of fuel proportional to the duration of the injection pulse signal J (the injection pulse duration) is injected by the injectors 1F.

Intake air is distributed to each cylinder of the engine 1 by means of an air supply pipe (not shown). An air filter, the airflow sensor, a throttle valve, a surge tank, and an intake manifold are disposed in the air supply pipe in that order from an upstream end.

Fuel (such as gasoline) in the fuel tank 3 is drawn into a low-pressure pump 4 driven by a motor 4M. Low-pressure fuel discharged by the low-pressure pump 4 is supplied to a high-pressure pump 7 via a fuel filter 5 and a low-pressure pipe 6.

A low-pressure return pipe 6A having a low-pressure regulator 9 disposed therein branches from the low-pressure pipe 6, returning to the fuel tank 3.

The high-pressure fuel pump 7 is driven by the engine 1, the rotational frequency of the high-pressure fuel pump 7 corresponding to the rotational frequency of the engine 1.

FIG. 13 is a characteristic graph showing the relationship between engine rotational frequency Ne and the discharge cycle TP of the high-pressure pump 7. Because the rotational frequency of the high-pressure pump 7 is proportional to the rotational frequency Ne of the engine, the discharge cycle TP of the high-pressure pump 7 is shortened as the engine rotational frequency Ne increases, as shown in FIG. 13.

In FIG. 12, high-pressure fuel discharged from the high-pressure pump 7 is supplied to the injectors 1F via the high-pressure pipe 8. A high-pressure return pipe 8A having a high-pressure regulator 10 disposed therein branches from the high-pressure pipe 8, a downstream end of the high-pressure return pipe 8A converging with the low-pressure pipe 6 and the low-pressure return pipe 6A.

The low-pressure regulator 9 adjusts the amount of fuel returning to the fuel tank 3 from the low-pressure return pipe 6A. The pressure of fuel supplied by the low-pressure pump 4 to the high-pressure pump 7 is adjusted to a predetermined low pressure depending on the amount of fuel returned by the low-pressure regulator 9.

The high-pressure regulator 10 is driven by an excitation current Ri (a control signal) supplied by the ECU 20, and adjusts the amount of fuel returned to the low-pressure return pipe 6A, and adjusts the actual fuel pressure PF acting on the injectors 1F to the target fuel pressure PFo.

In other words, the high-pressure regulator 10 returns fuel from the downstream side of the high-pressure fuel pump 7 to the low-pressure side by continuously changing the cross-sectional area of an opening of the high-pressure return pipe 8A in response to the excitation current Ri.

The fuel pressure sensor 12 detects the fuel pressure PF in the high-pressure pipe 8.

The ECU 20 not only receives fuel pressure information PF from the fuel pressure sensor 12, but also receives information about the running state from the various sensors 2, performing predetermined computational processes and outputting a calculated control signal to various actuators.

For example, the ECU 20 seeks the mean fuel pressure PFm from the fuel pressure PF detected by the fuel pressure sensor 12 and outputs a control signal which will make the mean fuel pressure PFm match the target fuel pressure PFo.

Next, the mean fuel pressure computing operation according to a conventional fuel injection control assembly for a cylinder-injected engine.

FIG. 14 is a timing chart showing the operation of the fuel pressure detecting process and the averaging process according to a conventional fuel injection control assembly for a cylinder-injected engine.

FIG. 14 shows changes in the injection pulse signal J and the fuel pressure PF over time. In FIG. 14, TC is the calculation cycle for the mean fuel pressure PFm (see dotted chain line) by the ECU 20, and TJ is the length of the injection pulse signal J. t is the fuel pressure detection cycle of the ECU 20, the fuel pressure PF being detected once in each cycle t.

In the waveform of the fuel pressure PF, the white circles represent detected values of fuel pressure PF used to compute the mean, and the black circles represent detected values of fuel pressure PF not used to compute the mean.

Because the fuel pressure PF decreases over the time period of the injection pulse duration TJ (when fuel is being injected), the fuel pressure PF detected during this time period (black circles) is eliminated from the calculation of the mean fuel pressure PFm. Moreover, the broken line represents the changes in fuel pressure during fuel shutoff.

First, when the injectors 1F are activated by the injection pulse signal J, fuel is injected by the injectors 1F, and the fuel pressure PF changes as indicated by the solid line in FIG. 14. Moreover, when the injection pulse duration TJ is zero (a fuel shutoff state), the fuel pressure PF increases in response to the discharge operation of the high-pressure fuel pump 7 as indicated by the broken line in FIG. 14.

At that time, in the calculation of the mean fuel pressure PFm, the calculation cycle TC is set in response to the discharge cycle TP of the high-pressure pump 7, and the mean fuel pressure PFm is only calculated from the fuel pressure (PF) detected at time periods other than the fuel injection time period (see white circles).

Consequently, when the injection pulse duration TJ is long, the number of times that fuel pressure PF is detected is insufficient, making calculation of the mean fuel pressure difficult. In running conditions where the load is high, the injection pulse duration TJ is even longer, reducing the opportunities for detecting fuel pressure even further, and in the worst cases, there is a risk that it will not be possible to detect the fuel pressure at all.

Because the discharge cycle TP is reduced as the rotational frequency Ne of the engine increases when the high-pressure pump 7 used is driven by the engine 1 as explained above (see FIG. 13), in the high-revolution region, the number of times that fuel pressure PF is detected during each calculation cycle TC (corresponding to the discharge cycle TP) is reduced.

Because calculation of the weighted mean of the fuel pressure PF detected in each predetermined detection cycle t for each calculation cycle TC as shown in FIG. 14 does not take into consideration the reduction in the number of times that fuel pressure is detected in the high-revolution region, changes in the fuel pressure PF cannot be ascertained accurately, and there is a risk that it will be impossible to calculate the mean fuel pressure PFm.

FIG. 15 is a timing chart showing the fuel pressure detection process and the averaging process when the discharge cycle TP of the high-pressure pump 7 has been shortened by an increase in the engine rotational frequency Ne. In FIG. 15, t1 to t11 are the detection times for the fuel pressure PF.

In this case, the calculation cycle TC for the mean fuel pressure PFm is shorter than in FIG. 14, and the fuel pressure PF detected at times t1, t5, and t6 is used to calculate the mean fuel pressure PFm in the first half of the chart and the fuel pressure PF detected at times t7, t10, and t11 is used to calculate the mean fuel pressure PFm in the second half of the chart.

In other words, in each calculation cycle TC, only three detected values of fuel pressure PF are averaged, making the number of times that fuel pressure PF is detected and used to calculate the average fuel pressure PFm in each calculation cycle TC very small.

As a result, due to the number of times that fuel pressure PF is detected being insufficient, different mean fuel pressures PFm are calculated for the same movements in fuel pressure PF (see dotted chain lines in FIG. 15). Thus, when the engine 1 is running at high-speed and the discharge cycle TP of the high-pressure pump 7 is short, calculation errors for the mean fuel pressure PFm increase, making it difficult to calculate the mean fuel pressure PFm accurately.

In addition, if the excitation current Ri for the high-pressure regulator 10 or the injection pulse duration TJ for the injectors 1F is controlled during sudden changes in the running state of the engine 1 (during transitional running due to acceleration or deceleration) or when the target fuel pressure PFo or the injection timing is altered, the control does not follow the actual changes in fuel pressure PF, and there is a risk that control precision for the injected fuel will deteriorate, causing the air-fuel ratio to deviate from a target value.

As explained above, because a conventional fuel injection control assembly for a cylinder-injected engine does not take into consideration the deleterious effects which changes in the running state and changes in fuel pressure PF have on the precision of the calculation of mean fuel pressure PFm, one problem has been that the time periods in which fuel pressure PF can be detected (time periods other than when fuel is being injected) are extremely short when the engine 1 is in a high-load state, the injection pulse duration TJ is increased, and the fuel injection time period is long, and in the worst cases, it is not possible to calculate the mean fuel pressure PFm at all.

SUMMARY OF THE INVENTION

The present invention aims to solve the above problems and an object of the present invention is to provide a fuel injection control assembly for a cylinder-injected engine in which reliability is improved by always detecting fuel pressure stably even if the running state of the engine and the target fuel pressure are altered, calculating the mean fuel pressure accurately and precisely, and employing a control calculation using a precise mean fuel pressure.

Another object of the present invention is to provide a fuel injection control assembly for a cylinder-injected engine in which the mean fuel pressure is calculated accurately and precisely based on fuel pressure detected stably, and in which tracking by the control calculation is improved.

In order to achieve the above objects, according to one aspect of the present invention, there is provided a fuel injection control assembly for a cylinder-injected engine including:

- various sensors for detecting the running state of the engine;
- an injector for injecting fuel directly into a cylinder of the engine;
- a high-pressure pump for supplying high-pressure fuel to the injector;
- a fuel pressure detecting means for detecting in a predetermined cycle fuel pressure acting on the injector;
- a mean fuel pressure calculating means for calculating mean fuel pressure from the fuel pressure detected by the fuel pressure detecting means;
- a fuel pressure regulator for adjusting the fuel pressure; and
- an injection pulse calculating means for calculating an injection pulse duration for the injector based on the mean fuel pressure,
- a cycle modifying means for modifying the calculation cycle of the mean fuel pressure calculating means in response to the running speed of the engine or of the high-pressure pump being disposed therein,
- the cycle modifying means setting the calculation cycle to a length greater than or equal to a running cycle of the high-pressure pump to ensure that a number of times that fuel pressure is detected within each calculation cycle of the mean fuel pressure calculating means is greater than or equal to a predetermined number of times.

A fuel injection control assembly for a cylinder-injected engine according to the present invention may also include a predetermined running state determining means for determining when the running state of the engine is in a predetermined running state in which the fuel pressure cannot be detected at or above a predetermined number of times within the calculation cycle, the cycle modifying means modifying the calculation cycle to an integral multiple of at least two or more times a normal calculation cycle when it is determined that the engine is in the predetermined running state.

A fuel injection control assembly for a cylinder-injected engine according to the present invention may also include a transitional running state determining means for determining when the running state of the engine is in a transitional running state during acceleration or deceleration, the injection pulse calculating means adjusting the injection pulse duration based on the fuel pressure detected by the fuel pressure detecting means instead of using the mean fuel pressure to control the injection pulse duration when it is determined that the engine is in the transitional running state.

In a fuel injection control assembly for a cylinder-injected engine according to the present invention, the injection pulse calculating means may also adjust the injection pulse duration based on the mean fuel pressure when a fuel pressure difference between the fuel pressure detected by the fuel pressure detecting means and the mean fuel pressure is less than or equal to a predetermined value, and adjust the injection pulse duration based on the fuel pressure detected by the fuel pressure detecting means when the fuel pressure difference is greater than the predetermined value.

In a fuel injection control assembly for a cylinder-injected engine according to the present invention, the predetermined value functioning as a standard reference for the fuel pressure difference may also be set to be greater than or equal to a surge amplitude of the fuel pressure acting on the injector.

A fuel injection control assembly for a cylinder-injected engine according to the present invention may also include an injection timing determining means for determining a fuel injection timing of the injector, and a mean fuel pressure correcting means for correcting the mean fuel pressure in response to the fuel injection timing, the injection pulse calculating means adjusting the injection pulse duration based on the corrected mean fuel pressure.

A fuel injection control assembly for a cylinder-injected engine according to the present invention may also include a fuel pressure controlling means for performing fuel pressure feedback control such that the mean fuel pressure matches a target fuel pressure, the fuel pressure controlling means performing fuel pressure feedback control based on a first fuel pressure difference consisting of a difference between the mean fuel pressure and the target fuel pressure when a difference between a previous value and a present value of the target fuel pressure is less than a predetermined variance, and switching to a fuel pressure feedback control based on a second fuel pressure difference consisting of a difference between the fuel pressure detected by the fuel pressure detecting means and the target fuel pressure when the difference between the previous value and the present value of the target fuel pressure is greater than or equal to the predetermined variance.

In a fuel injection control assembly for a cylinder-injected engine according to the present invention, the fuel pressure controlling means may also perform fuel pressure feedback control based on the second fuel pressure difference when the difference between the previous value and the present value of the target fuel pressure is greater than or equal to the predetermined variance, thereafter reverting to the fuel pressure feedback control based on the first fuel pressure difference at a point in time when the second fuel pressure difference decreases to within the predetermined value.

In a fuel injection control assembly for a cylinder-injected engine according to the present invention, the injection pulse calculating means may also adjust the injection pulse duration based on the mean fuel pressure when the difference between the previous value and the present value of the target fuel pressure is less than the predetermined variance, switching to adjustment of the injection pulse duration based on the fuel pressure detected by the fuel pressure detecting means when the difference between the previous value and the present value of the target fuel pressure is greater than or equal to the predetermined variance.

In a fuel injection control assembly for a cylinder-injected engine according to the present invention, the injection pulse calculating means may also perform adjustment of the injection pulse duration based on the fuel pressure detected by the fuel pressure detecting means when the difference between the previous value and the present value of the target fuel pressure is greater than or equal to the predetermined variance, thereafter reverting to adjustment of the injection pulse duration based on the mean fuel pressure at a point in time when the second fuel pressure difference decreases to within the predetermined value.

A fuel injection control assembly for a cylinder-injected engine according to the present invention may also include a transitional running state determining means for determining when the engine is in a transitional running state during acceleration or deceleration, the fuel pressure controlling means performing fuel pressure feedback control based on the first fuel pressure difference when it is determined that the engine is in the transitional running state, and performing fuel pressure feedback control based on the second fuel pressure difference when it is determined that the engine is not in the transitional running state.

In a fuel injection control assembly for a cylinder-injected engine according to the present invention, the fuel pressure controlling means may also perform fuel pressure feedback control based on the first fuel pressure difference when the fuel pressure difference between the fuel pressure detected by the fuel pressure detecting means and the mean fuel pressure is less than the predetermined value, and perform fuel pressure feedback control based on the second fuel pressure difference when the fuel pressure difference is greater than or equal to the predetermined value.

DETAILED DESCRIPTION OF THE PREFERRED EMBODIMENTS

Embodiment 1

Embodiment 1 of the present invention will be explained below with reference to the drawings.

Figure 1:
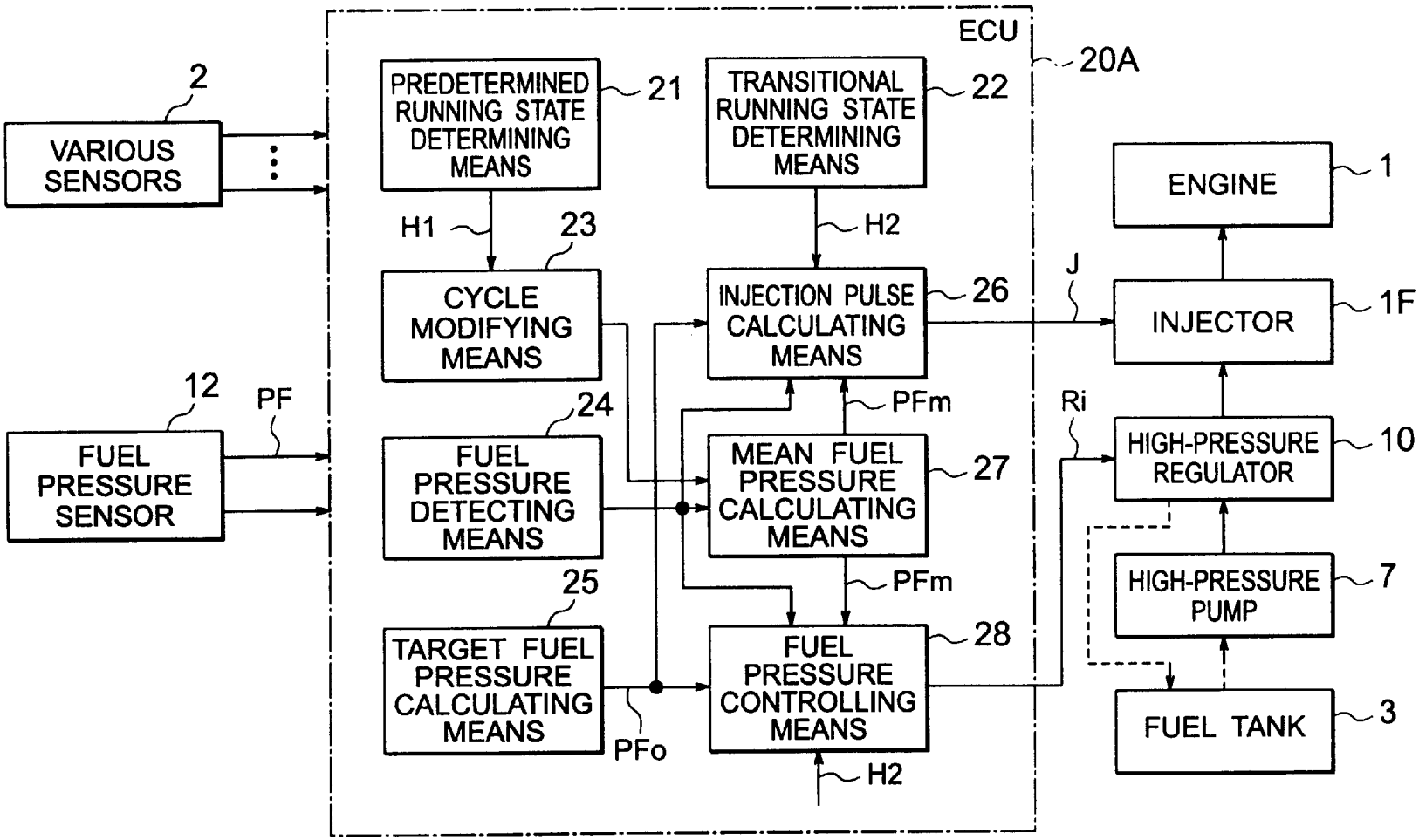
FIG. 1 is a functional block diagram schematically showing Embodiment 1 of the present invention.
Figure 12:
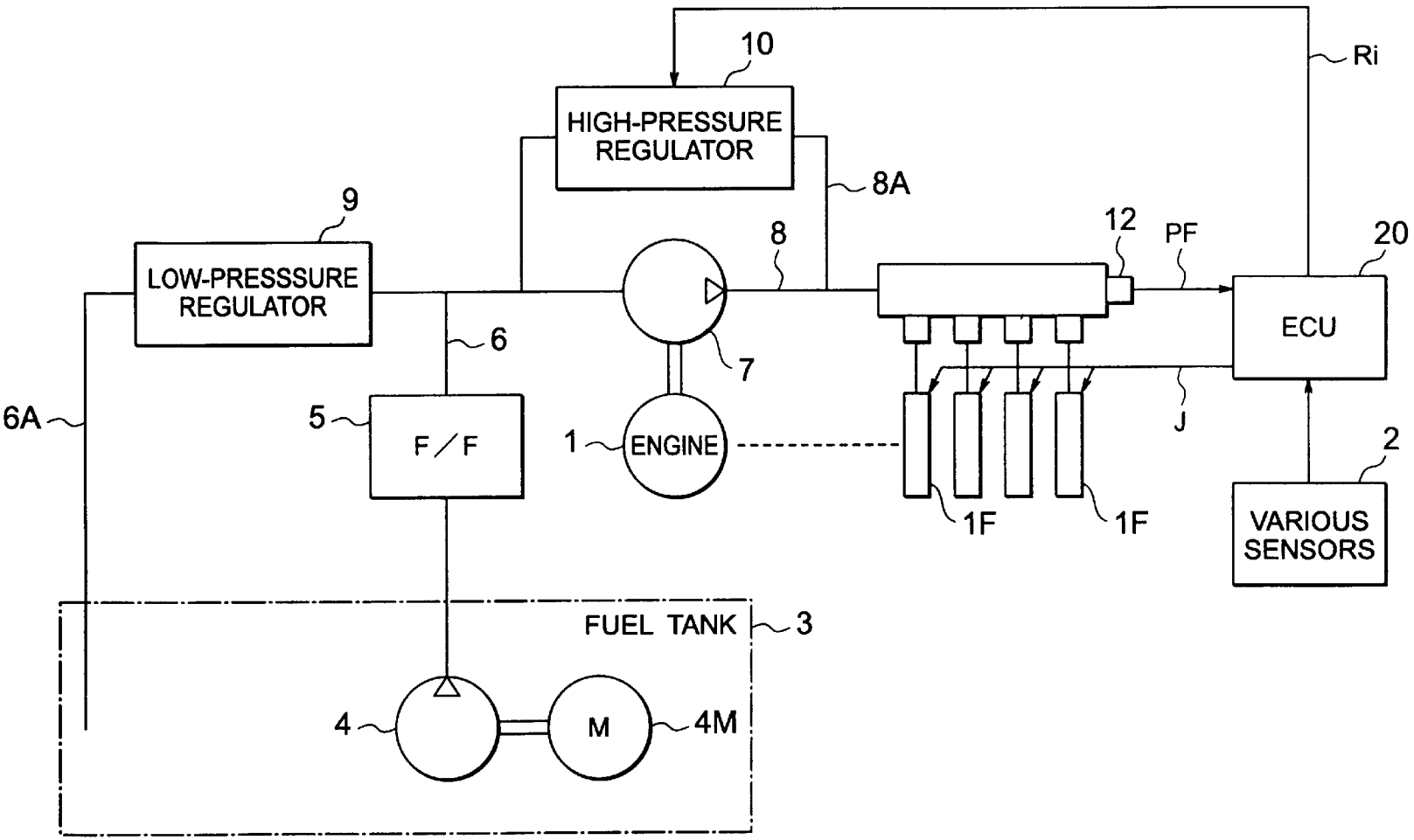
FIG. 12 PRIOR ART
FIG. 12 is a structural diagram schematically showing a generic fuel injection control assembly for a cylinder-injected engine.

FIG. 1 is a functional block diagram schematically showing Embodiment 1 of the present invention, constructions not shown being the same as those shown in FIG. 12. Moreover, constructions the same as those explained in the conventional example (see FIG. 12) will be given the same numbering and detailed explanation thereof will be omitted.

In FIG. 1, ECU 20A includes: a predetermined running state determining means 21; a transitional running state determining means 22; a cycle modifying means 23; a fuel pressure detecting means 24; a target fuel pressure calculating means 25; an injection pulse calculating means 26; a mean fuel pressure calculating means 27; and a fuel pressure controlling means 28.

The predetermined running state determining means 21 generates a determined signal H1 when the engine 1 is in a predetermined running state, but does not generate the determined signal H1 when the engine 1 is in a normal running state. Here, the predetermined running state is a running state (the high-revolution region, for example) in which the fuel pressure PF cannot be detected at or above a predetermined number of times QN (10 times, for example) within the calculation cycle TC.

The transitional running state determining means 22 generates a determined signal H2 indicating a transitional running state (accelerating or decelerating state) when an accelerating or decelerating state of the engine 1 is detected based on operational information from an accelerator aperture sensor, an intake air volume sensor, a brake switch, etc., (not shown) in the various sensors 2 and the engine 1 is deemed to be in a predetermined accelerating or decelerating state.

The cycle modifying means 23 modifies the calculation cycle TC of the mean fuel pressure calculating means 27 in response to the running speed (rotational frequency) of the engine 1 or the high-pressure pump 7. Because it is inversely proportional to the engine rotational frequency Ne (see FIG. 13), the discharge cycle TP of the high-pressure pump 7 being driven by the engine 1 can easily be inferred from the engine rotational frequency Ne.

The cycle modifying means 23 sets the calculation cycle TC to a length greater than or equal to the running cycle (discharge cycle TP) of the high-pressure pump 7 to ensure that the number of times that fuel pressure is detected is greater than or equal to the predetermined number of times QN within each calculation cycle TC of the mean fuel pressure calculating means 27.

More specifically, when the determined signal Hi indicating that the engine 1 is in the predetermined running state is input to the cycle modifying means 23, the cycle modifying means 23 modifies the calculation cycle TC of the mean fuel pressure calculating means 27 to an integral multiple of at least two or more times the normal calculation cycle.

The fuel pressure detecting means 24 detects the fuel pressure PF acting on the injectors 1F in a predetermined detection cycle t, and the target fuel pressure calculating means 25 maps the target fuel pressure PFo in response to the running state.

The injection pulse calculating means 26 normally calculates the injection pulse duration TJ for the injectors 1F based on the running state and the mean fuel pressure PFm and outputs the injection pulse signal J.

More specifically, when the fuel pressure difference (=|PF−PFm|) between the fuel pressure PF detected by the fuel pressure detecting means 24 and the mean fuel pressure PFm is less than a predetermined value β (normal running), the injection pulse calculating means 26 adjusts the injection pulse duration TJ based on the mean fuel pressure PFm.

When the fuel pressure difference (=|PF−PFm|) is greater than or equal to the predetermined value β, the injection pulse calculating means 26 adjusts the injection pulse duration TJ based on the fuel pressure PF detected by the fuel pressure detecting means 24 instead of using the mean fuel pressure PFm to control the injection pulse duration TJ.

In addition, when the determined signal H2 indicating that the engine 1 is in the transitional running state is input to the injection pulse calculating means 26, the injection pulse calculating means 26 adjusts the injection pulse duration TJ based on the fuel pressure PF detected by the fuel pressure detecting means 24 instead of using the mean fuel pressure PFm to control the injection pulse duration TJ.

The mean fuel pressure calculating means 27 calculates the mean fuel pressure PFm from the fuel pressure PF detected by the fuel pressure detecting means 24 within the time period of the calculation cycle TC set by the cycle modifying means 23.

The fuel pressure controlling means 28 normally uses the mean fuel pressure PFm to make the fuel pressure acting on the injectors 1F equal to the target fuel pressure PFo, performing feedback control by generating the excitation current Ri for the high-pressure regulator 10 (the fuel pressure regulator) so that the mean fuel pressure PFm matches the target fuel pressure PFo.

More specifically, when the difference between a previous value and a present value of the target fuel pressure PFo is less than a predetermined variance (normal running), the fuel pressure controlling means 28 performs feedback control based on a first fuel pressure difference (PFo−PFm) consisting of the difference between the mean fuel pressure PFm and the target fuel pressure PFo.

When the difference between the previous value and the present value of the target fuel pressure PFo is greater than or equal to the predetermined variance (during modification of the target fuel pressure), the fuel pressure controlling means 28 switches to fuel pressure feedback control based on a second fuel pressure difference (PFo−PF) consisting of the difference between the fuel pressure PF detected by the fuel pressure detecting means 24 and the target fuel pressure PFo.

Thereafter, at a point in time when the absolute value of the second fuel pressure difference decreases to be less than or equal to a predetermined value, the fuel pressure controlling means 28 reverts to fuel pressure feedback control based on the first fuel pressure difference (=PFo−PFm) using the mean fuel pressure PFm.

When the determined signal H2 has not been input, the fuel pressure controlling means 28 performs fuel pressure feedback control based on the first fuel pressure difference, and when the determined signal H2 has been input (when it is determined that the engine is in the transitional running state), the fuel pressure controlling means 28 performs fuel pressure feedback control based on the second fuel pressure difference.

In addition, when the fuel pressure difference (=|PF−PFm|) between the fuel pressure PF detected by the fuel pressure detecting means 24 and the mean fuel pressure PFm is less than the predetermined value β, the fuel pressure controlling means 28 performs fuel pressure feedback control based on the first fuel pressure difference, and when the fuel pressure difference is greater than or equal to the predetermined value β, the fuel pressure controlling means 28 performs fuel pressure feedback control based on the second fuel pressure difference.

Figure 2:
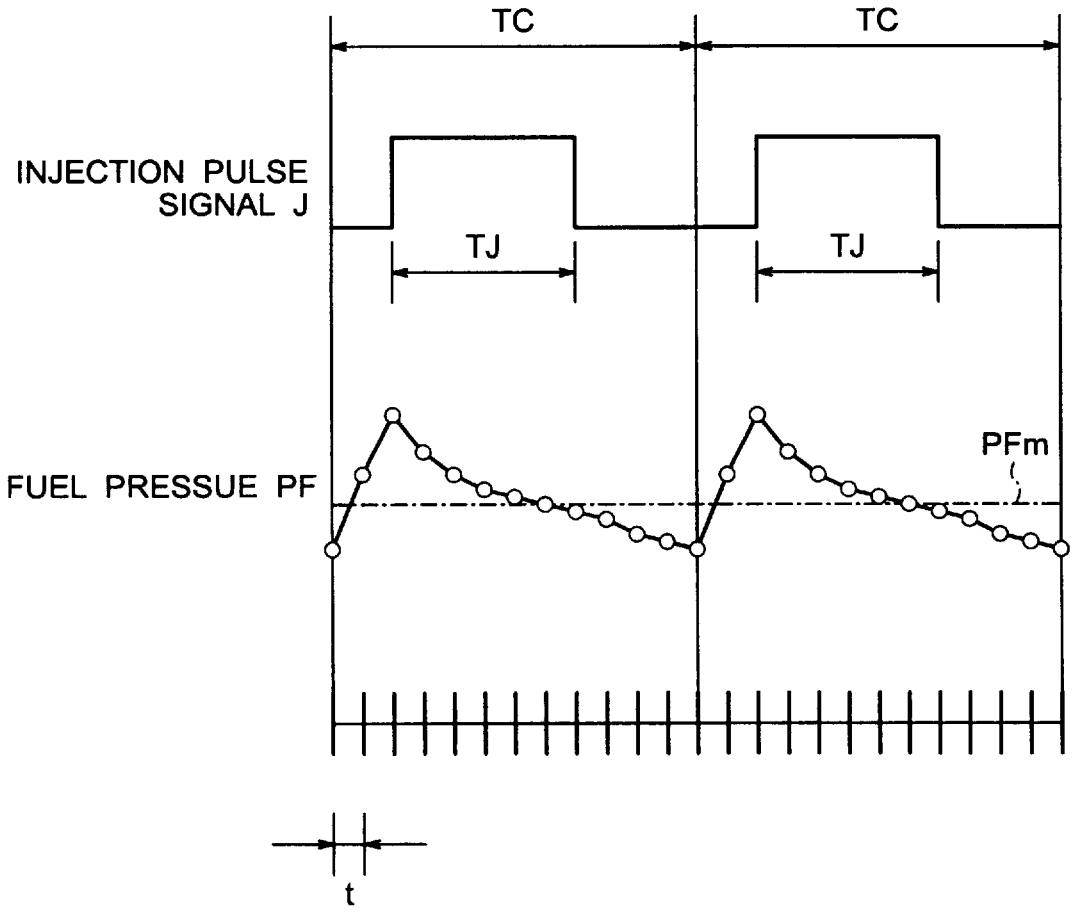
FIG. 2 is a timing chart showing a fuel pressure detecting process according to Embodiment 1 of the present invention.
Figure 3:
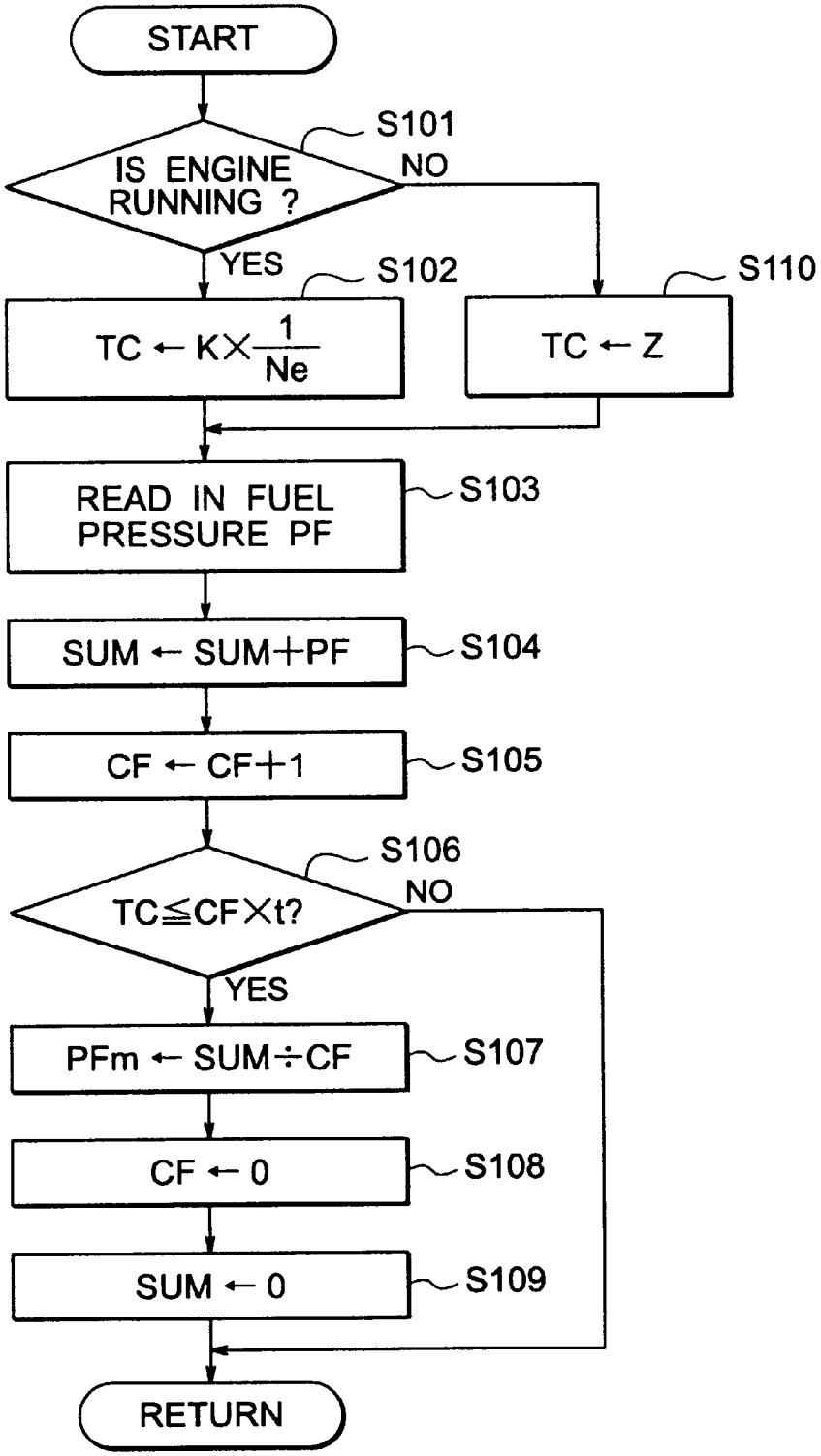
FIG. 3 is a flow chart showing an averaging process according to Embodiment 1 of the present invention.

Next, the calculating operation for the mean fuel pressure PFm under normal running conditions according to Embodiment 1 of the present invention shown in FIG. 1 will be explained with reference to FIGS. 2 and 3. FIGS. 2 and 3 are a timing chart and a flow chart, respectively, showing a fuel pressure detecting process and an averaging process according to Embodiment 1 of the present invention.

Figure 14:
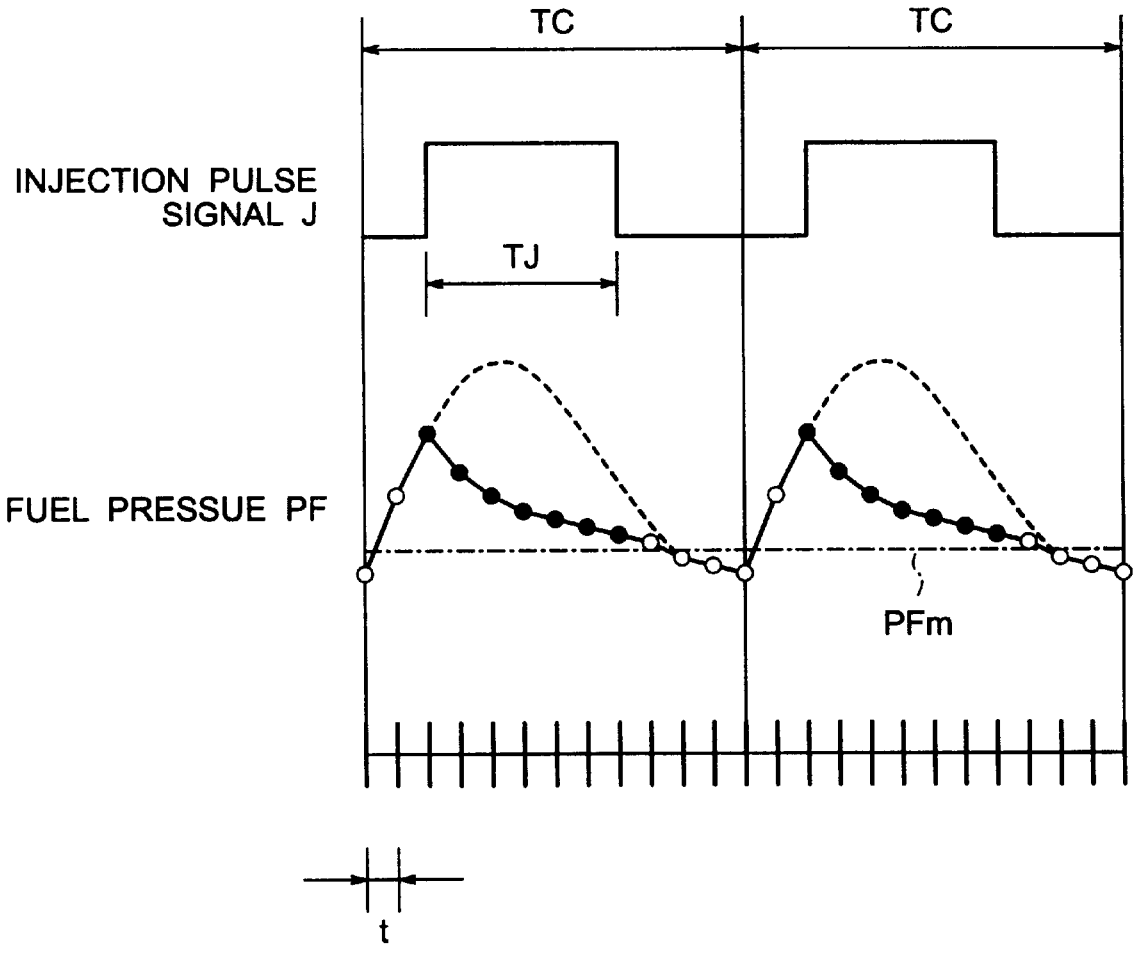
FIG. 14 PRIOR ART
FIG. 14 is a timing chart showing the operation of a fuel pressure detecting process and an averaging process according to a conventional fuel injection control assembly for a cylinder-injected engine.
Figure 15:
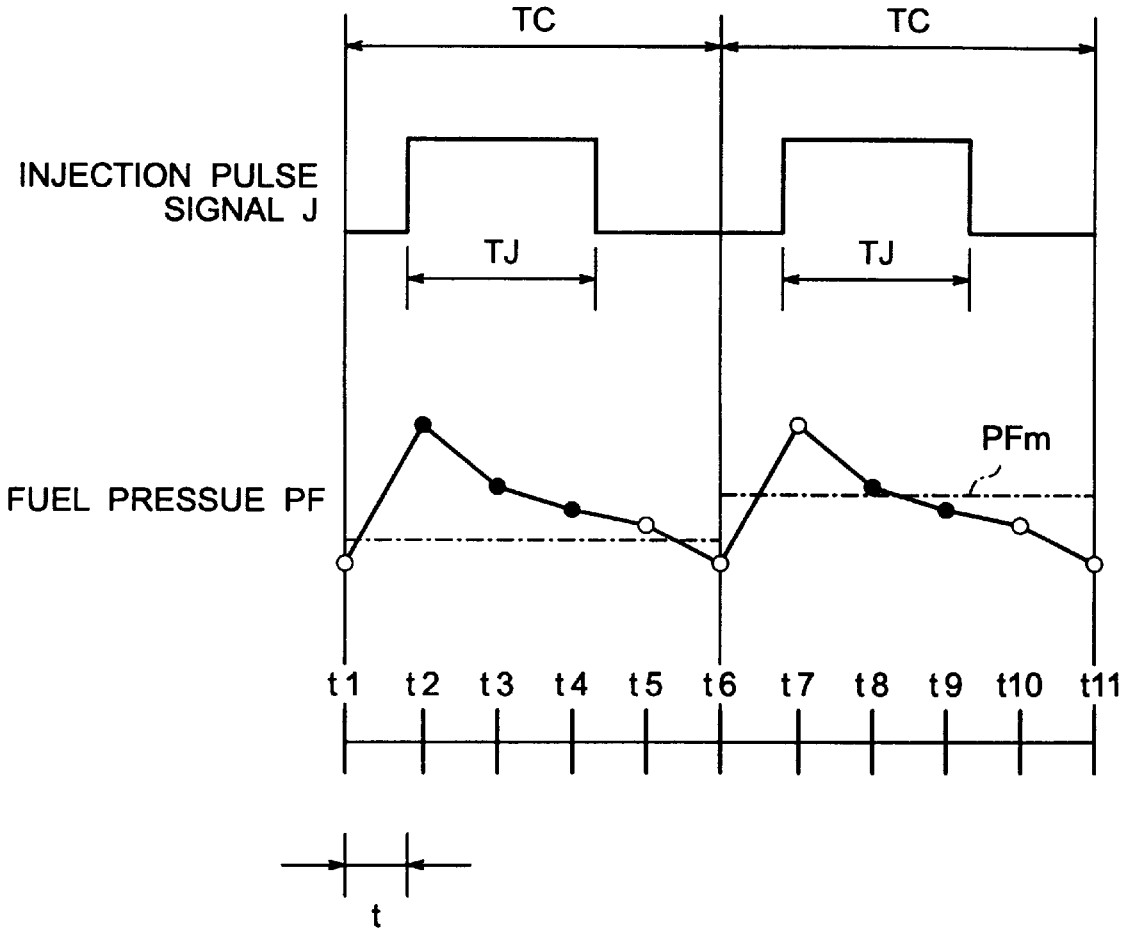
FIG. 15 PRIOR ART
FIG. 15 is a timing chart showing the fuel pressure detecting process and the averaging process when engine rotational frequency is increased according to a conventional fuel injection control assembly for a cylinder-injected engine.

In FIG. 2, portions the same as those explained in the conventional example (see FIG. 14) will be given the same numbering and detailed explanation thereof will be omitted.

In this case, because all of the detected values of fuel pressure PF (white circles) from each of the detection timings t1 to t11 are used in the calculation of the mean fuel pressure PFm, mean fuel pressure PFm (dotted chain line) substantially equal to the actual mean fuel pressure can be consistently calculated without being dependent on the injection pulse duration TJ as the conventional example is.

Moreover, the processing routine of the mean fuel pressure calculating means 27 shown in FIG. 3 is performed each time the fuel pressure detecting means 24 detects the fuel pressure PF (each detection cycle t).

In FIG. 3, a value in a counter CF for counting the number of times that fuel pressure has been detected and a value in a memory SUM for adding together and storing the detected fuel pressure values are cleared to zero by the main routine (not shown) immediately after power is switched on.

Figure 13:
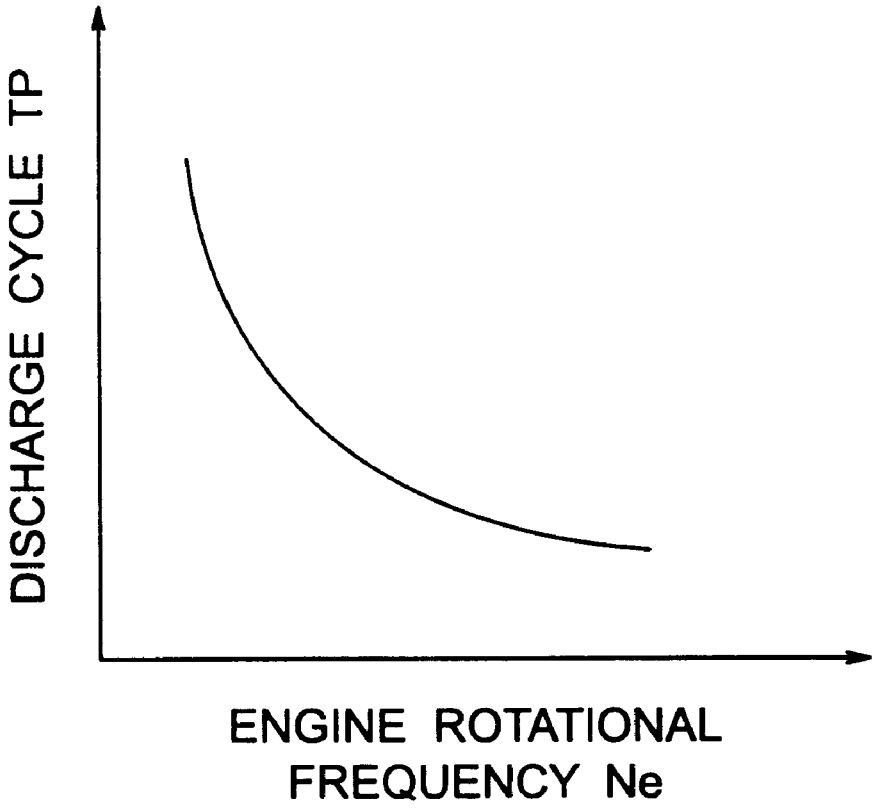
FIG. 13 PRIOR ART
FIG. 13 is a characteristic graph showing the relationship between engine rotational frequency and the discharge cycle of a generic high-pressure pump.

In addition, the discharge cycle TP of the high-pressure pump 7 is first calculated by the main routine based on the characteristics described in the conventional example (see FIG. 13).

In FIG. 3, a determination is first made as to whether or not the engine 1 is running (step S101), and if it is determined that the engine 1 is running (i.e., YES), the calculation cycle TC of the mean fuel pressure calculating means 27 is set in response to the engine rotational frequency Ne according to Expression (1) below.

$$TC=K/Ne \tag{1}$$

In Expression (1), K is a constant based on the characteristics of FIG. 13.

On the other hand, if it is determined that the engine 1 is stopped (i.e., NO), the calculation cycle TC of the mean fuel pressure calculating means 27 is set to a constant value Z (step S110). Moreover, because the calculation cycle TC is renewed by the calculation in step S102 when the engine 1 is running, the constant value Z can be set to any arbitrary value.

Then, the fuel pressure PF detected by the fuel pressure detecting means 24 is read in (step S103), the read fuel pressure PF is added to and stored in the memory SUM (step S104) and the counter CF is incremented (step S105).

Next, the calculation cycle TC set in step S102 and the total detection time (=CF×t) for the fuel pressure PF are compared to determine whether or not TC is less than or equal to CF×t (step S106). Moreover, the total detection time of the fuel pressure PF stored in the memory SUM can be found by multiplying the counter CF by the fuel pressure detection cycle t.

If it is determined in step S106 that TC is greater than CF×t (i.e., NO), then the processing routine in FIG. 3 is exited without performing a calculation process for the mean fuel pressure PFm because the total detection time for the fuel pressure PF has not reached one calculation cycle TC.

On the other hand, if it is determined in step S106 that TC is less than or equal to CF×t (i.e., YES), then the mean fuel pressure PFm within the calculation period TC is calculated according to Expression (2) below using the values in the memory SUM and the counter CF (step S107) because the total detection time for the fuel pressure PF has reached one calculation cycle TC.

$$PFm=\mathrm{SUM}/CF \tag{2}$$

Lastly, the counter CF is cleared to zero (step S108), the memory SUM is cleared to zero (step S109), and the processing routine in FIG. 3 is exited.

Thus, the values of fuel pressure PF detected in each of the predetermined detection cycles t in the calculation cycle TC which is set in response to the engine rotational frequency Ne are averaged.

By calculating the mean of the values of fuel pressure PF detected in the predetermined cycles t in response to the engine rotational frequency Ne (in every discharge cycle TP of the high-pressure pump 7) in this manner, accurate and stable mean fuel pressure PFm can be obtained consistently, even if the injection pulse duration TJ increases.

Consequently, in the normal running state, fuel pressure PF can be detected greater than or equal to a predetermined number of times QN in each calculation cycle TC, and the averaging process can be performed using the calculation cycle TC set in step S102 without modification.

Next, the averaging process in a predetermined state in which fuel pressure PF values cannot be detected a sufficient number of times (the predetermined number of times QN) in each calculation cycle TC will be explained with reference to FIGS. 4 and 5.

Figure 4:
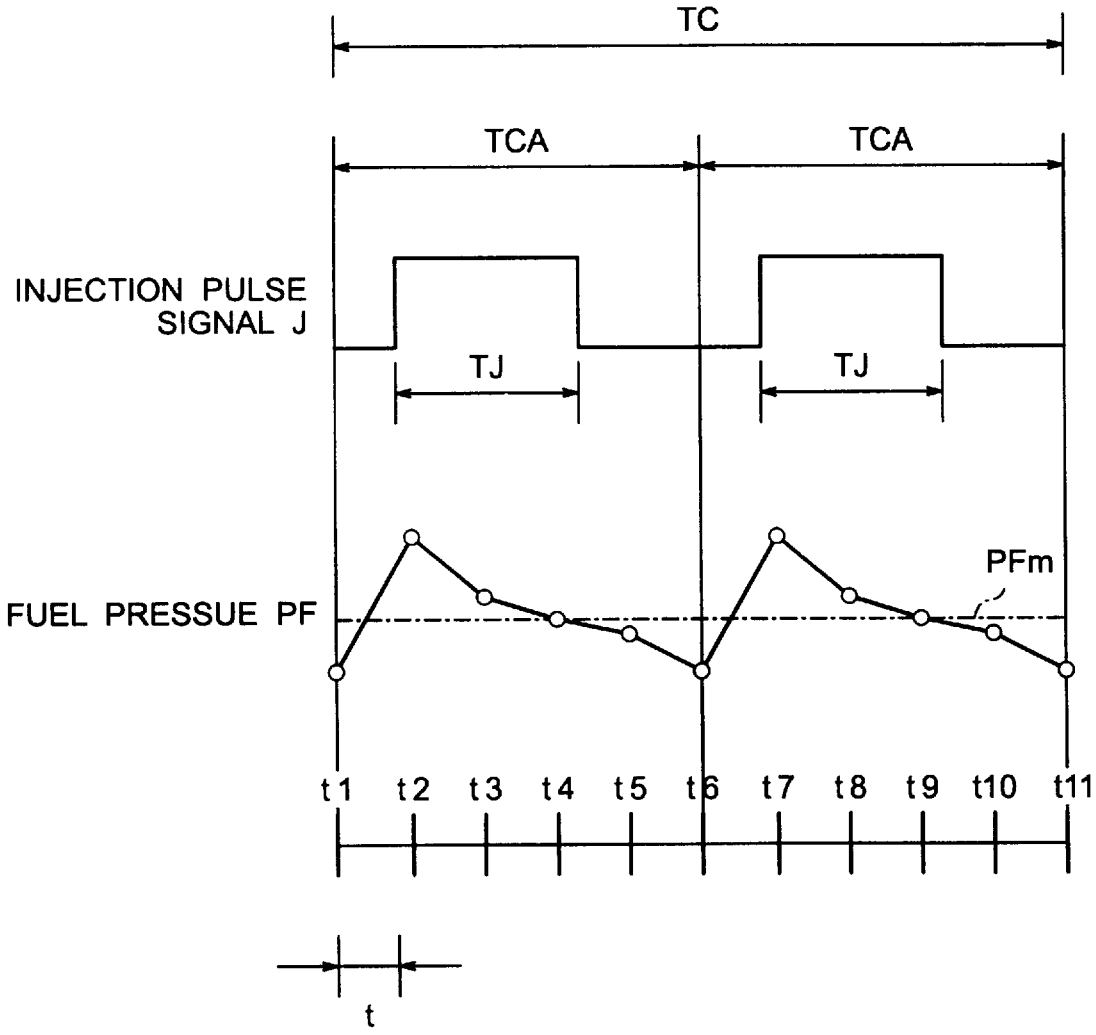
FIG. 4 is a timing chart showing fuel pressure detection and averaging processes in a predetermined running state (high-revolution region) according to Embodiment 1 of the present invention.
Figure 5:
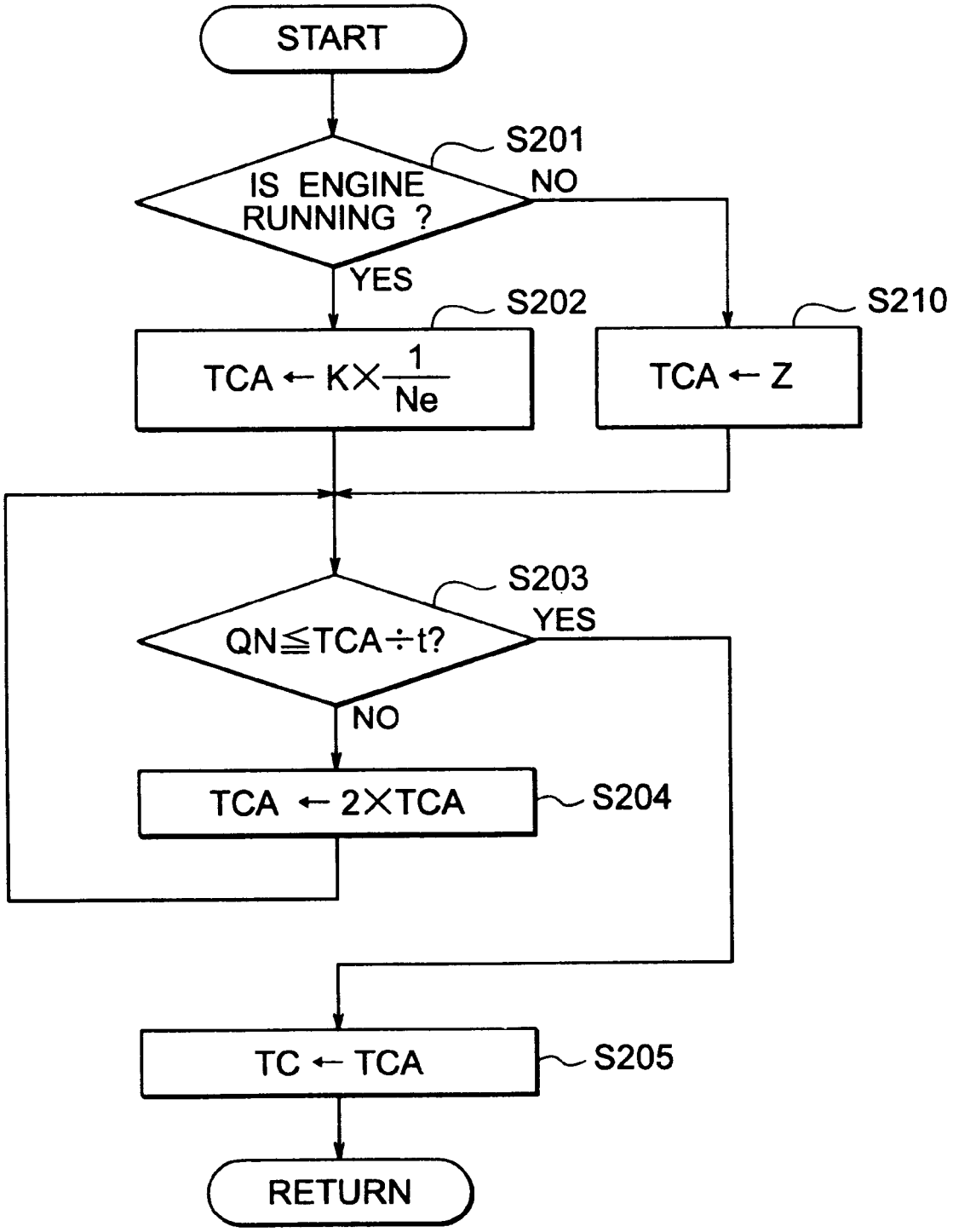
FIG. 5 is a flow chart showing a cycle modifying process in the predetermined running state according to Embodiment 1 of the present invention.

FIG. 4 is a timing chart showing fuel pressure detecting and averaging processes in a predetermined running state (high-revolution region), and FIG. 5 is a flow chart showing a cycle modifying process in the predetermined running state.

In FIG. 4, because the engine rotational frequency Ne has increased beyond that described above (see FIG. 2), fuel pressure PF cannot be detected greater than or equal to the predetermined number of times QN without modifying the normal calculation cycle TCA.

Consequently, the mean fuel pressure PFm is calculated by modifying the calculation cycle TC to twice its normal length (=2×TCA). FIG. 4 shows the case in which the predetermined number of times QN has been obtained using a calculation cycle TC which is twice the normal length.

In this manner, the number of times that fuel pressure is detected for the averaging process can be ensured to be greater than or equal to the predetermined number of times QN without being dependent on the engine rotational frequency Ne, enabling mean fuel pressure PFm substantially equal to the actual mean fuel pressure to be consistently calculated as indicated by the dotted chain line in FIG. 4.

In the flow chart in FIG. 5, because steps S201, S202, and S210 are the same processes as steps S101, S102, and S110 above, respectively, (see FIG. 3), they will not be explained in detail here.

Furthermore, step S203 in FIG. 5 corresponds to the process of the predetermined running state determining means 21 in FIG. 1, and steps S204 and S205 correspond to the process of the cycle modifying means 23.

First, if the engine is running, a temporary calculation cycle TCA is set in step S202.

Next, the predetermined number of times QN (=10 times) for the averaging process and the number of times (=TCA/t) that fuel pressure PF can possibly be detected in the temporary calculation cycle TCA are compared to determine whether or not QN is less than or equal to TCA/t (step S203).

If it is determined that QN is less than or equal to TCA/t (i.e., YES), then the temporary calculation cycle TCA is used as the final calculation cycle TC without modification (step S205) because the fuel pressure PF can be detected greater than or equal to the predetermined number of times QN in the temporary calculation cycle TCA, and the processing routine in FIG. 5 is exited.

On the other hand, if it is determined in step S203 that QN is greater than TCA/t (i.e., NO), then the temporary calculation cycle TCA is reset to twice its length (step S204) because the number of times that fuel pressure can be detected in the temporary calculation cycle TCA has not reached the predetermined number of times QN, and the routine returns to step S203.

If it is determined in the repeated step S203 that QN is less than or equal to TCA/t (i.e., YES), then the processing routine in FIG. 5 is exited via step S205, but if it is again determined that QN is greater than TCA/t (i.e., NO), then the temporary calculation cycle TCA is further reset to twice its length (step S204), and the routine returns to step S203.

Step S204 is repeated until it is determined in step S203 that QN is less than or equal to TCA/t (i.e., YES).

As a result, the calculation cycle TC can be reliably set to enable the fuel pressure PF to be detected greater than or equal to the predetermined number of times QN even in the predetermined running state (high-revolution region), ensuring reliability in the calculation of the mean fuel pressure PFm.

Moreover, the calculation cycle TC is adjusted here using a multiple of two in the cycle modifying process step S204, but successive increments may also be performed using an integer greater than 2.

By modifying the calculation cycle TC by an integral multiple of two or more times the normal value in this manner if the fuel pressure PF cannot be detected greater than or equal to the predetermined number of times QN in the normal calculation period TCA, the number of times that the fuel pressure is detected can be ensured and accurate and stable fuel pressure information can be consistently detected even if the engine rotational frequency Ne increases (i.e., the discharge cycle TP of the high-pressure pump 7 is shortened).

Next, the processing operation of the transitional running state determining means 22 in FIG. I will be explained with reference to the flow chart in FIG. 6.

First, running state information is read in from the various sensors 2 (step S301), and a determination is made as to whether or not the engine 1 is accelerating or decelerating (i.e., in a transitional running state) (step S302).

Figure 6:
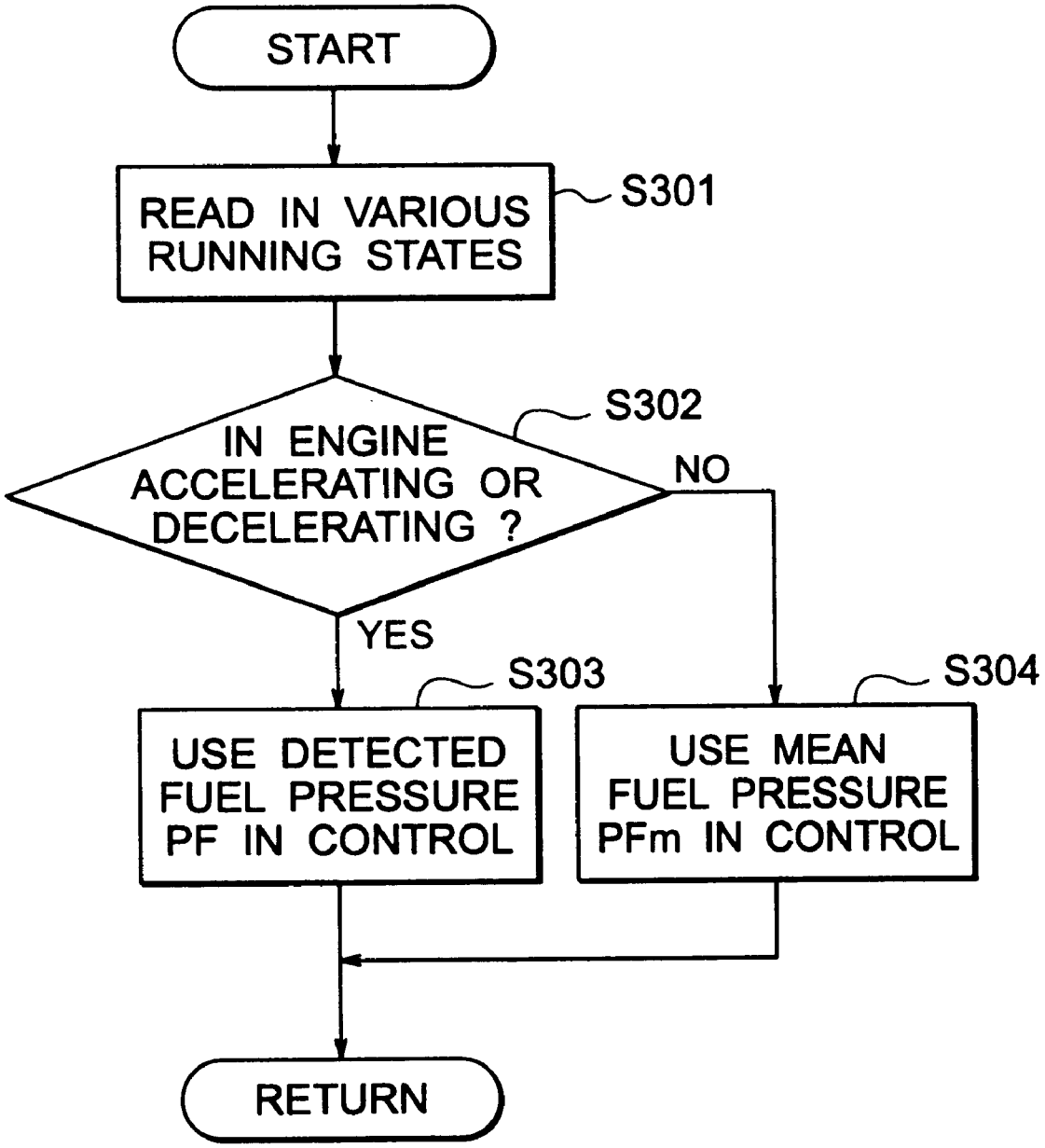
FIG. 6 is a flow chart showing a processing operation of a transitional running state determining means according to Embodiment 1 of the present invention.

If it is determined that the engine 1 is in the transitional running state (i.e., YES), then a determined signal H2 is generated so that the fuel pressure PF detected by the fuel pressure detecting means 24 is used in the control (step S303), and the processing routine in FIG. 6 is exited. This time, in response to the determined signal H2, the injection pulse calculating means 26 and the fuel pressure controlling means 28 use the fuel pressure PF detected by the fuel pressure detecting means 24 instead of the mean fuel pressure PFm to adjust the injection pulse signal J and the excitation current Ri.

Consequently, tracking of the injectors 1F and the high-pressure regulator 10 by the control is not lost even in the transitional running state.

On the other hand, if it is determined in step S302 that the engine 1 is not in the transitional running state (i.e., NO), then the mean fuel pressure PFm is used in the control (step S304), and the processing routine in FIG. 6 is exited.

In this manner, the fuel pressure feedback control and control of the adjustment of the injection pulse duration TJ are performed using either the fuel pressure PF detected in every detection cycle or the mean fuel pressure PFm (steps S303 and S304) in accordance with the result determined instep S302.

Consequently, control which tracks the actual fuel pressure PF can be achieved even during transitional running due to acceleration or deceleration.

Next, the operation of the injection pulse calculating means 26 and the fuel pressure controlling means 28 when the target fuel pressure PFo is modified will be explained with reference to the flow chart in FIG. 7.

Figure 7:
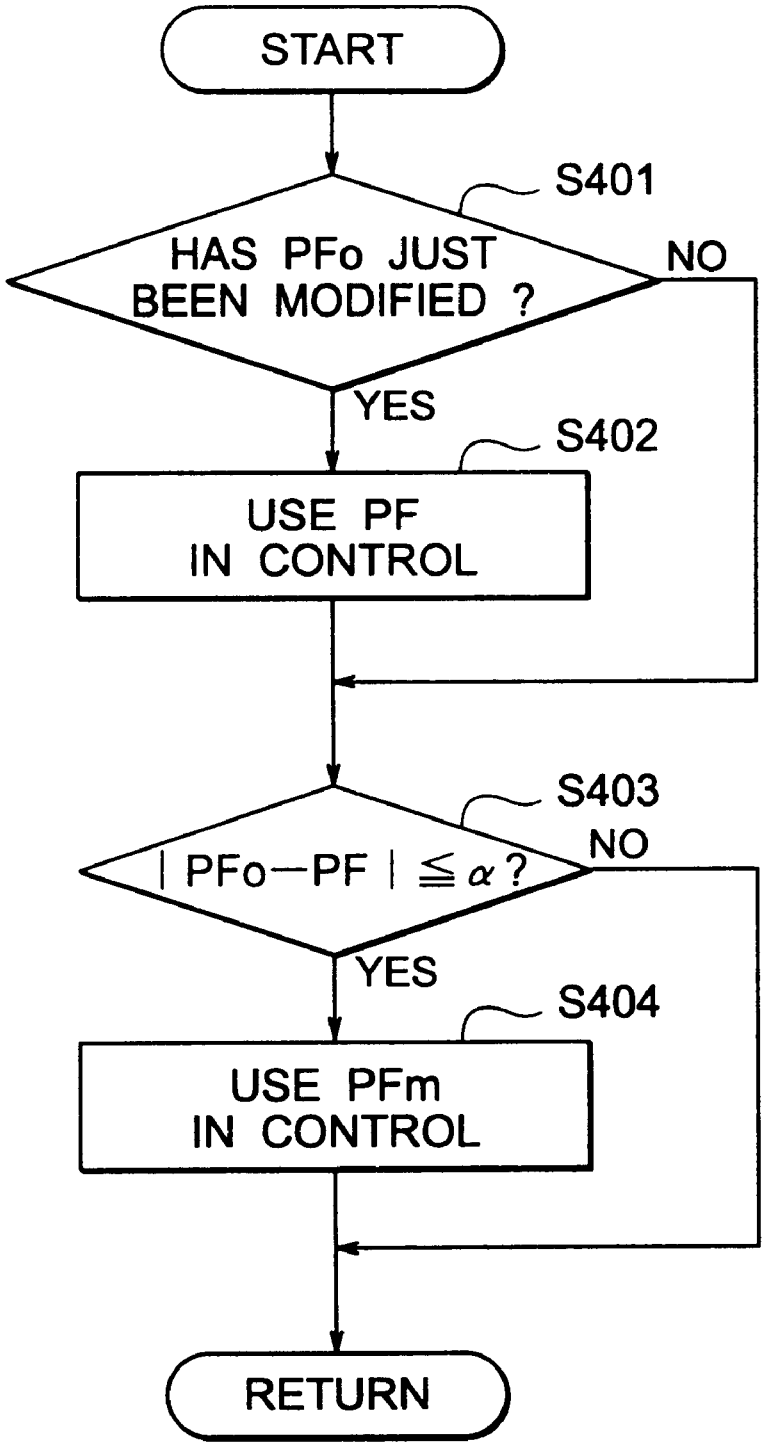
FIG. 7 is a f low chart showing operation of an injection pulse calculating means and a fuel pressure controlling means when a target fuel pressure is modified according to Embodiment 1 of the present invention.

Steps S402 and S404 in FIG. 7 correspond to steps S302 and S303 above, respectively (see FIG. 6).

First, a determination is made as to whether or not the target fuel pressure PFo by the fuel pressure controlling means has just been modified by determining whether or not the difference between a previous value and a present value of the target fuel pressure PFo is greater than or equal to a predetermined variance (step S401).

If it is determined that the target fuel pressure PFo has just been modified (i.e., YES), then control is switched to use the fuel pressure PF detected by the fuel pressure detecting means 24 instead of using the mean fuel pressure PFm (step S402).

This time, the injection pulse calculating means 26 and the fuel pressure controlling means 28 use the fuel pressure PF detected by the fuel pressure detecting means 24 instead of the mean fuel pressure PFm to adjust the injection pulse signal J and the excitation current Ri.

Consequently, tracking of the injectors 1F and the high-pressure regulator 10 by the control is not lost even if the target fuel pressure PFo is modified.

On the other hand, if it is determined that the target fuel pressure PFo has not just been modified (i.e., NO), then the process of switching from the mean fuel pressure PFm to the fuel pressure PF (step S402) is skipped.

Next, a determination is made as to whether or not the difference between the fuel pressure PF and the target fuel pressure PFo (=|PFo−PF|) is less than or equal to a predetermined value (step S403).

If it is determined that |PFo−PF| is less than or equal to (i.e., YES), then control (injection pulse adjustment and fuel pressure feedback control) using the mean fuel pressure PFm is restored (step S404) because the fuel pressure PF is convergent with a range in which the difference relative to the modified target fuel pressure PFo is less than or equal to the predetermined value, and the processing routine in FIG. 7 is exited.

If it is determined instep S403 that |PFo−PF| is greater than (i.e., NO), then the processing routine in FIG. 7 is exited without performing the control restoring process (step S404) because the fuel pressure PF is not convergent with the predetermined range relative to the modified target fuel pressure PFo.

In this manner, the fuel pressure feedback control and control of the adjustment of the injection pulse duration TJ are performed using either the fuel pressure PF detected in every detection cycle or the mean fuel pressure PFm in accordance with the result determined in step S402.

For example, in the case of fuel pressure control, if the target fuel pressure remains constant, then control based on the first fuel pressure difference between the mean fuel pressure PFm and the target fuel pressure PFo is performed, and if the target fuel pressure PFo is modified by an amount greater than or equal to the predetermined value, then control based on the second fuel pressure difference between the detected fuel pressure PF and the target fuel pressure PFo is performed.

Consequently, fuel pressure control which tracks the actual fuel pressure PF becomes possible even during changes in the fuel pressure PF.

Furthermore, because stable fuel pressure control based on the first fuel pressure difference between the mean fuel pressure PFm and the target fuel pressure PFo is restored when the difference between the actual fuel pressure PF and the target fuel pressure PFo is convergent to within the predetermined value, convergence when the actual fuel pressure PF reaches the target fuel pressure PFo can be improved.

Next, the operation of the injection pulse calculating means 26 and the fuel pressure controlling means 28 when the fuel pressure PF changes suddenly will be explained with reference to FIGS. 8 and 9.

Figure 8:
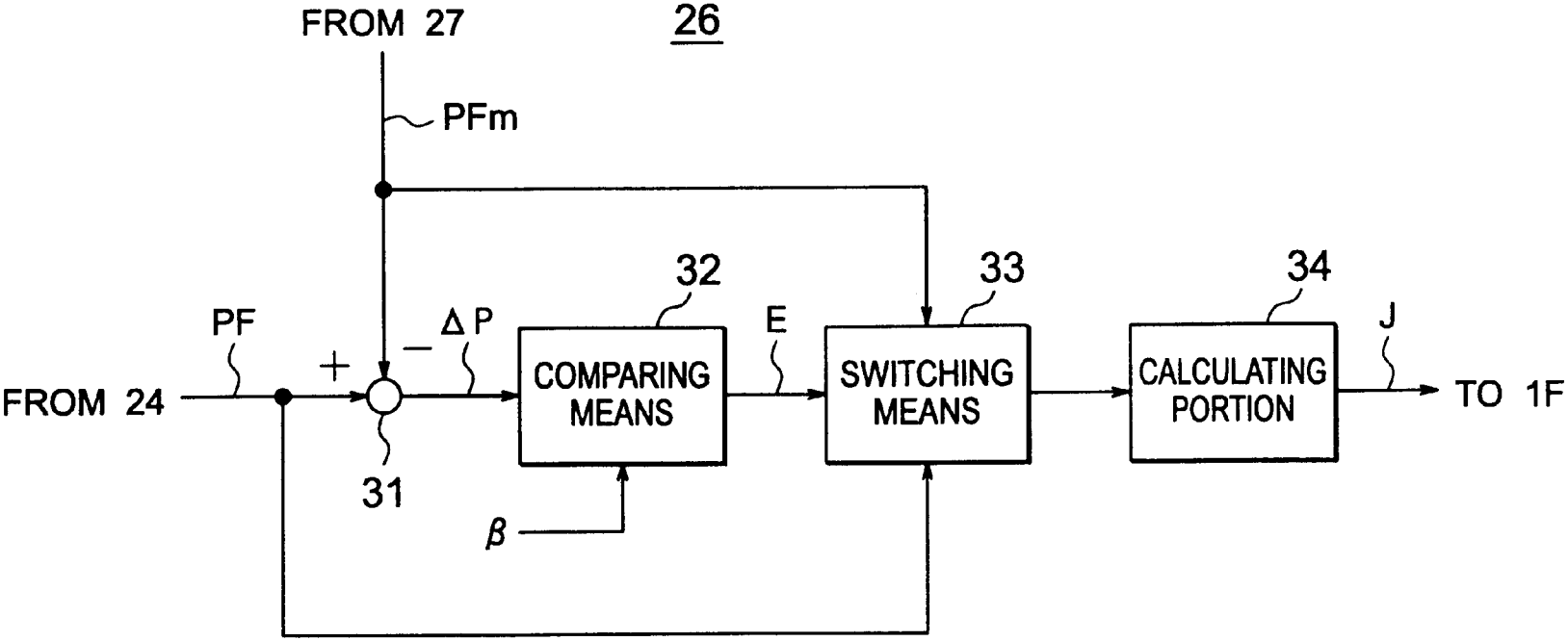
FIG. 8 is a functional block diagram showing a specific construction of the injection pulse calculating means according to Embodiment 1 of the present invention.
Figure 9:
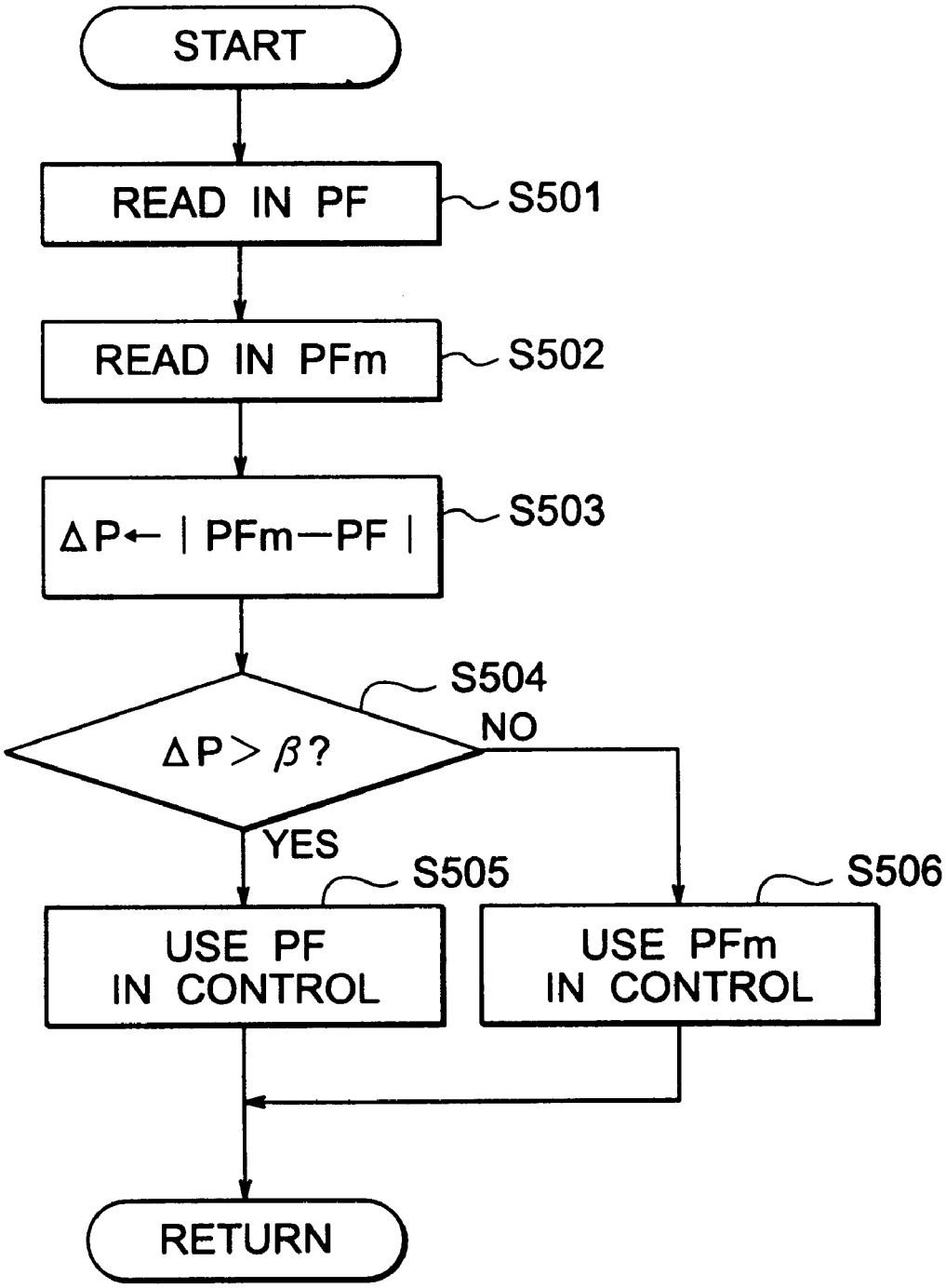
FIG. 9 is a flow chart showing a processing operation when fuel pressure changes suddenly according to Embodiment 1 of the present invention.

FIG. 8 is a functional block diagram showing a specific construction of the injection pulse calculating means 26, and FIG. 9 is a flow chart showing the processing operation when the fuel pressure PF changes suddenly.

The injection pulse calculating means 26 in FIG. 8 includes a subtracter 31, a comparing means 32, a switching means 33, and a calculating portion 34.

Moreover, the construction of the fuel pressure controlling means 28 is the same as in FIG. 8 except that the calculating portion 34 is replaced by a fuel pressure controlling portion, and separate explanation thereof will be omitted here.

The subtracter 31 calculates the difference ΔP (=|PFm−PF|) between the fuel pressure PF and the mean fuel pressure PFm.

The comparing means 32 compares the fuel pressure difference ΔP and the predetermined value β and generates a switching signal E if the fuel pressure difference ΔP is greater than the predetermined value β.

The predetermined value β is a value ascertained experimentally and is prestored in the comparing means 32. More specifically, the predetermined value β is set to greater than or equal to the amplitude of surges in the fuel pressure PF, thus enabling suppression of excessive adjustment of the injection pulse duration TJ relative to regular surges in the fuel pressure PF.

The switching means 33 selects the fuel pressure information input to the calculating means 34 to either the mean fuel pressure PFm or the fuel pressure PF, normally selecting the mean fuel pressure PFm, but selecting the fuel pressure PF if the switching signal E is input to the switching means 33.

Consequently, if the difference ΔP between the fuel pressure PF and the mean fuel pressure PFm exceeds the predetermined value β, the calculating means 34 performs the adjustment calculation for the injection pulse duration TJ based on the detected fuel pressure PF instead of the mean fuel pressure PFm.

Thereafter, when the fuel pressure difference αP converges to the predetermined value β or below and the switching signal E from the comparing means 32 is turned off, the switching means 33 outputs selection of the mean fuel pressure PFm, and the calculating portion 34 is restored to the calculating process using the mean fuel pressure PFm.

In FIG. 9, steps S501 to S503 correspond to the processing operation of the subtracter 31 in FIG. 8, and step S504 corresponds to the processing operation of the comparing means 32. Furthermore, steps S505 and S506 correspond to steps S302 and S303 above, respectively (see FIG. 6).

First, the fuel pressure PF detected by the fuel pressure detecting means 24 is read in (step S501), and the mean fuel pressure PFm from the mean fuel pressure calculating means 27 is read in (step S502).

Next, the difference ΔP (=|PFm−PF|) between the fuel pressure PF and the mean fuel pressure PFm is calculated (step S503), and the fuel pressure difference ΔP and the predetermined value β are compared to determine whether or not ΔP is greater than β (step S504).

If it is determined that ΔP is greater than β (i.e., YES), then the fuel pressure PF is used as the fuel pressure information for the control (step S505), and if it is determined that ΔP is less than or equal to β (i.e., NO), then the mean fuel pressure PFm is used as the fuel pressure information for the control (step S506), and in either case the processing routine in FIG. 9 is then exited.

Thereafter, the control of the adjustment of the injection pulse duration TJ and fuel pressure feedback control are performed by the injection pulse calculating means 26 and the fuel pressure controlling means 28 in accordance with the result determined in step S504 (steps S505 and S506).

In this manner, fuel pressure control which tracks the actual fuel pressure PF becomes possible even during sudden changes in the fuel pressure PF.

For example, in the case of the calculation for adjusting the injection pulse duration TJ using the fuel pressure information, if the fuel pressure difference ΔP is less than or equal to the predetermined value β (normal), then the more accurate and stable mean fuel pressure PFm is used, and if the fuel pressure difference ΔP exceeds the predetermined value β, then the fuel pressure PF is used.

Consequently, precise adjustment of the injection pulse duration TJ tracking the actual fuel pressure PF becomes possible even in cases in which the fuel pressure PF changes transitionally due to changes in the running state (acceleration or deceleration) or modification of the target fuel pressure PFo.

Furthermore, because the predetermined value β is set on the basis of at least the amplitude of surges in the fuel pressure PF acting on the injectors 1F, excessive adjustment of the injection pulse duration TJ relative to regular surges in the fuel pressure PF can be suppressed.

Moreover, precise adjustment of the injection pulse duration TJ tracking the actual fuel pressure PF becomes possible even during transitional changes in fuel pressure (or during fuel pressure switching) exceeding normal surge amplitude.

Embodiment 2

In Embodiment 1 above, changes in the mean fuel pressure PFm due to the presence or absence of fuel injection were not considered, but the mean fuel pressure PFm may also be corrected, taking into consideration changes in the mean fuel pressure PFm during injection and during non-injection.

Figure 10:
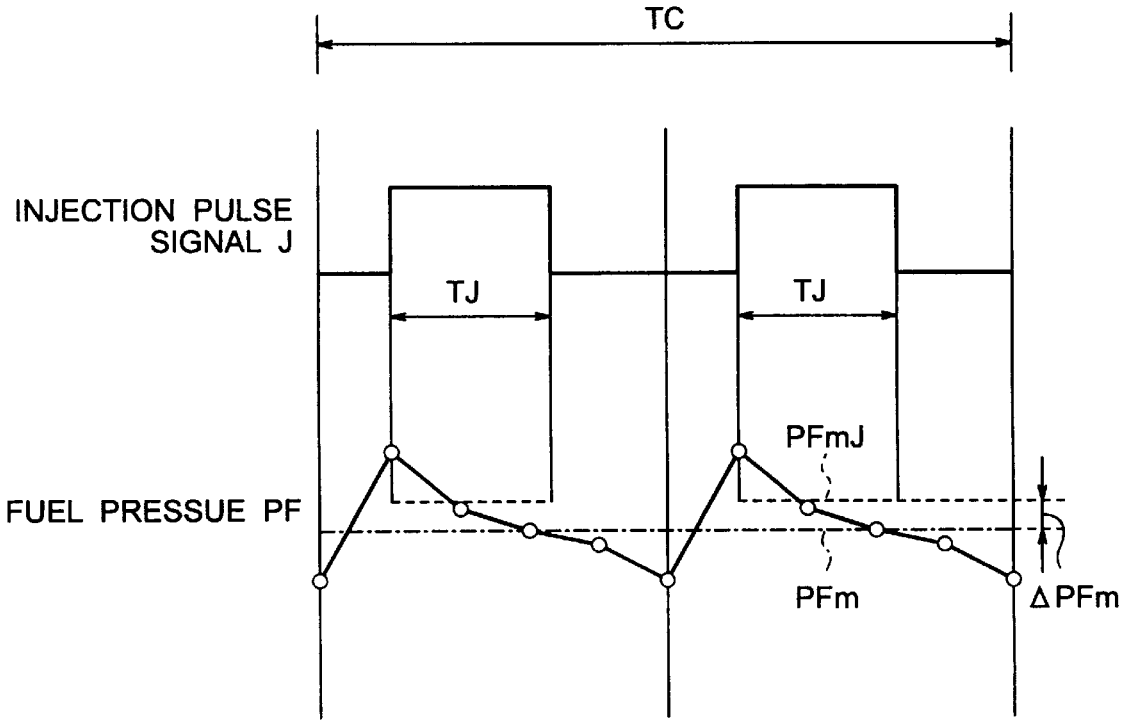
FIG. 10 is a timing chart explaining an offset in the mean fuel pressure due to the presence or absence of fuel injection according to Embodiment 2 of the present invention.

FIG. 10 is a timing chart explaining an offset ΔPFm in the mean fuel pressure PFm due to the presence or absence of fuel injection.

In FIG. 10, the mean fuel pressure PFmJ during injection only (broken line) and the mean fuel pressure PFm calculated over the calculation cycle TC (dotted chain line) differ by the offset ΔPFm.

Consequently, if the offset ΔPFm is measured experimentally in advance and stored as map data together with engine rotational frequency Ne and injection timing (the fuel injection timing), the mean fuel pressure PFm can be corrected using the offset ΔPFm.

A mean fuel pressure correcting operation according to Embodiment 2 of the present invention for correcting the mean fuel pressure PFm in response to the fuel injection timing will be explained below with reference to the flow chart in FIG. 11.

In this case, an ECU 20A (not shown) includes an injection timing determining means for determining the injection timing D (fuel injection timing) of the injectors 1F, and a mean fuel pressure correcting means for correcting the mean fuel pressure PFm in response to the fuel injection timing.

Furthermore, the injection pulse calculating means 26 is designed to adjust the injection pulse duration TJ based on a corrected mean fuel pressure PFmC.

Figure 11:
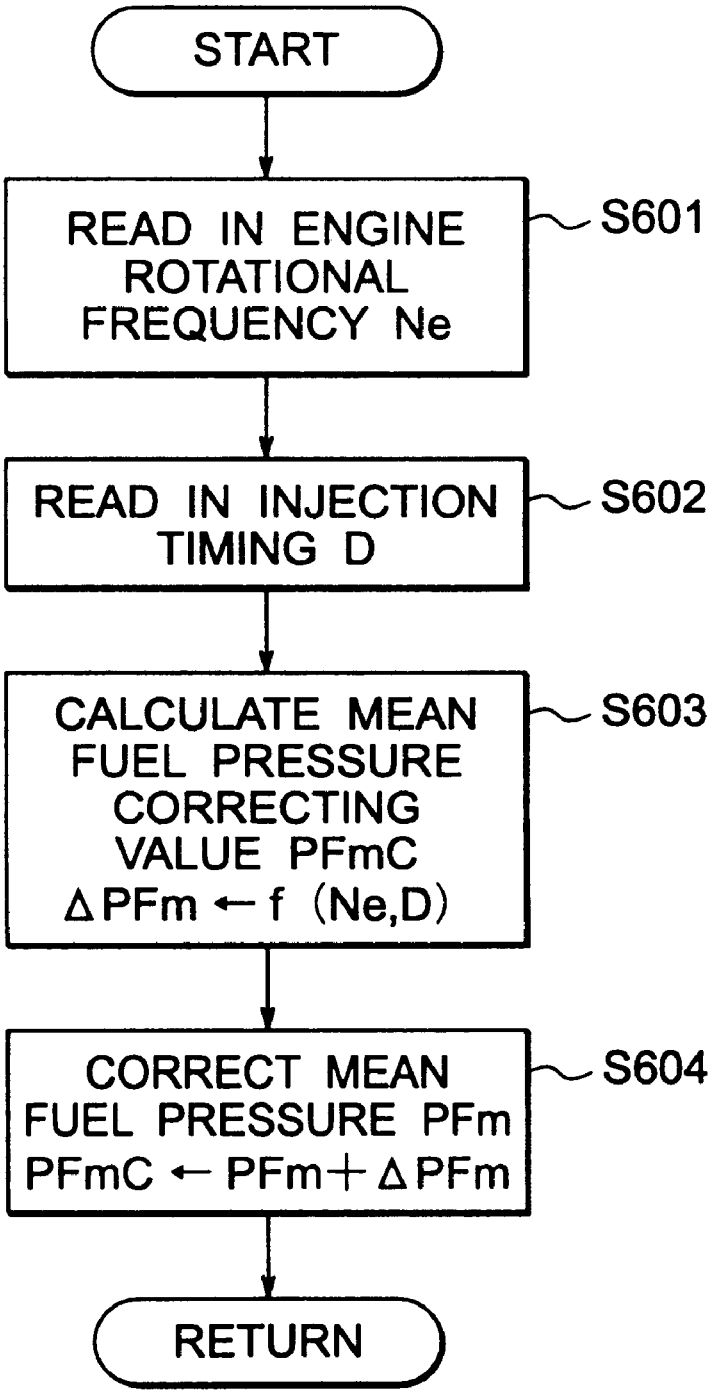
FIG. 11 is a flow chart showing a mean fuel pressure adjusting operation in response to fuel injection timing according to Embodiment 2 of the present invention.

In the ECU 20A in FIG. 11, first the engine rotational frequency Ne is read in (step S601), and the injection timing D (for example, the injection start time and the injection end time) calculated for the next fuel injection is read in (step S602).

Then, the offset ΔPFm consisting of a function f (Ne, D) of the engine rotational frequency Ne and the injection timing D is calculated as a mean fuel pressure correcting value (step S603).

This time, the offset ΔPFm between the mean fuel pressure PFm and the mean fuel pressure during injection PFmJ is stored in advance as map data related to engine rotational frequency Ne and injection timing D, and can be found by a map search.

Next, the mean fuel pressure correcting means calculates the corrected mean fuel pressure PFmC by adding the mean fuel pressure PFm calculated by the mean fuel pressure calculating means 27 and the offset ΔPFm (the mean fuel pressure correcting value) as in Expression (3) below (step S604), and the processing routine in FIG. 11 is exited.

$$PFmC=PFm+\Delta PFm \quad (3)$$

Thereafter, the injection pulse calculating means 26 performs the adjustment calculation for the injection pulse duration TJ using the corrected mean fuel pressure PFmC.

Thus, a highly precise injection pulse duration TJ can be ensured based on accurate fuel pressure information (the corrected mean fuel pressure PFmC).

Embodiment 3

Embodiment 1 above is explained for a case in which the fuel pressure in the high-pressure regulator 10 is feedback controlled by the fuel pressure controlling means 28, but a mechanical fuel pressure regulator in which feedback control is not performed may also be used instead of the high-pressure regulator 10.

In that case, because the fuel pressure controlling means 28 is not required, only the fuel pressure information used by the injection pulse calculating means 26 in the adjustment calculation is switched based on the above conditions.

What is claimed is:

1. A fuel injection control assembly for a cylinder-injected engine comprising:

various sensors for detecting a running state of said engine;

an injector for injecting fuel directly into a cylinder of said engine;

a high-pressure pump for supplying high-pressure fuel to said injector;

a fuel pressure detecting means for detecting in a predetermined cycle fuel pressure acting on said injector;

a mean fuel pressure calculating means for calculating mean fuel pressure from said fuel pressure detected by said fuel pressure detecting means;

a fuel pressure regulator for adjusting said fuel pressure; and an injection pulse calculating means for calculating an injection pulse duration for said injector based on said mean fuel pressure, a cycle modifying means being disposed therein for modifying a calculation cycle of said mean fuel pressure calculating means in response to one of a running speed of said engine and of said high-pressure pump, said cycle modifying means setting said calculation cycle to a length greater than or equal to a running cycle of said high-pressure pump to ensure that a number of times that said fuel pressure is detected within each calculation cycle of said mean fuel pressure calculating means is greater than or equal to a predetermined number of times.

2. The fuel injection control assembly for a cylinder-injected engine according to claim 1 comprising:

a predetermined running state determining means for determining when said running state of said engine is in a predetermined running state in which said fuel pressure cannot be detected at or above said predetermined number of times within said calculation cycle, said cycle modifying means modifying said calculation cycle to an integral multiple of at least two or more times a normal calculation cycle when it is determined that said engine is in said predetermined running state.

3. The fuel injection control assembly for a cylinder-injected engine according to claim 1 comprising:

a transitional running state determining means for determining when said running state of said engine is in a transitional running state during acceleration or deceleration, said injection pulse calculating means adjusting said injection pulse duration based on said fuel pressure detected by said fuel pressure detecting means instead of using said mean fuel pressure to control said injection pulse duration when it is determined that said engine is in said transitional running state.

4. The fuel injection control assembly for a cylinder-injected engine according to claim 1 wherein said injection pulse calculating means:

adjusts said injection pulse duration based on said mean fuel pressure when a fuel pressure difference between said fuel pressure detected by said fuel pressure detecting means and said mean fuel pressure is less than or equal to a predetermined value; and adjusts said injection pulse duration based on said fuel pressure detected by said fuel pressure detecting means when said fuel pressure difference is greater than said predetermined value.

5. The fuel injection control assembly for a cylinder-injected engine according to claim 4 wherein said predetermined value functioning as a standard reference for said fuel pressure difference is set to be greater than or equal to a surge amplitude of said fuel pressure acting on said injector.

6. The fuel injection control assembly for a cylinder-injected engine according to claim 1 comprising:

an injection timing determining means for determining a fuel injection timing of said injector; and a mean fuel pressure correcting means for correcting said mean fuel pressure in response to said fuel injection timing, said injection pulse calculating means adjusting said injection pulse duration based on said corrected mean fuel pressure.

7. The fuel injection control assembly for a cylinder-injected engine according to claim 1 comprising:

a fuel pressure controlling means for performing fuel pressure feedback control such that said mean fuel pressure matches a target fuel pressure, said fuel pressure controlling means:

performing fuel pressure feedback control based on a first fuel pressure difference consisting of a difference between said mean fuel pressure and said target fuel pressure when a difference between a previous value and a present value of said target fuel pressure is less than a predetermined variance; and switching to a fuel pressure feedback control based on a second fuel pressure difference consisting of a difference between said fuel pressure detected by said fuel pressure detecting means and said target fuel pressure when said difference between said previous value and said present value of said target fuel pressure is greater than or equal to said predetermined variance.

8. The fuel injection control assembly for a cylinder-injected engine according to claim 7 wherein said fuel pressure controlling means:

performs fuel pressure feedback control based on said second fuel pressure difference when said difference between said previous value and said present value of said target fuel pressure is greater than or equal to said predetermined variance, thereafter reverting to said fuel pressure feedback control based on said first fuel pressure difference at a point in time when said second fuel pressure difference decreases to within a predetermined value.

9. The fuel injection control assembly for a cylinder-injected engine according to claim 7 wherein said injection pulse calculating means:

adjusts said injection pulse duration based on said mean fuel pressure when said difference between said previous value and said present value of said target fuel pressure is less than said predetermined variance, and switching to adjustment of said injection pulse duration based on said fuel pressure detected by said fuel pressure detecting means when said difference between said previous value and said present value of said target fuel pressure is greater than or equal to said predetermined variance.

10. The fuel injection control assembly for a cylinder-injected engine according to claim 9 wherein said injection pulse calculating means:

performs adjustment of said injection pulse duration based on said fuel pressure detected by said fuel pressure detecting means when said difference between said previous value and said present value of said target fuel pressure is greater than or equal to said predetermined variance, thereafter reverting to adjustment of said injection pulse duration based on said mean fuel pressure at a point in time when said second fuel pressure difference decreases to within a predetermined value.

11. The fuel injection control assembly for a cylinder-injected engine according to claim 7 comprising:

a transitional running state determining means for determining when said engine is in a transitional running state during acceleration or deceleration, said fuel pressure controlling means:

performing fuel pressure feedback control based on said first fuel pressure difference when it is determined that said engine is in said transitional running state; and performing fuel pressure feedback control based on said second fuel pressure difference when it is determined that said engine is not in said transitional running state.

12. The fuel injection control assembly for a cylinder-injected engine according to claim 7 wherein said fuel pressure controlling means:

performs fuel pressure feedback control based on said first fuel pressure difference when said fuel pressure difference between said fuel pressure detected by said fuel pressure detecting means and said mean fuel pressure is less than a predetermined value; and performs fuel pressure feedback control based on said second fuel pressure difference when said fuel pressure difference is greater than or equal to said predetermined value.

* * * * *